US009052058B1

(12) United States Patent
Severson et al.

(10) Patent No.: US 9,052,058 B1
(45) Date of Patent: Jun. 9, 2015

(54) JEWELRY HOLDER

(71) Applicants: Bradley Troy Severson, Peoria, AZ (US); Elizabeth Dawn Severson, Peoria, AZ (US)

(72) Inventors: Bradley Troy Severson, Peoria, AZ (US); Elizabeth Dawn Severson, Peoria, AZ (US)

( * ) Notice: Subject to any disclaimer, the term of this patent is extended or adjusted under 35 U.S.C. 154(b) by 94 days.

(21) Appl. No.: 14/088,441

(22) Filed: Nov. 24, 2013

(51) Int. Cl.
*B60R 7/05* (2006.01)
*F16M 13/02* (2006.01)

(52) U.S. Cl.
CPC ..... *F16M 13/022* (2013.01)

(58) Field of Classification Search
CPC ..... F16M 13/022
USPC ..... 248/206.5, 206.2, 206.3, 301–304, 339
See application file for complete search history.

(56) References Cited

U.S. PATENT DOCUMENTS

| | | | | |
|---|---|---|---|---|
| 2,665,042 | A | 1/1954 | Starolis | |
| 4,936,466 | A | 6/1990 | Nava | |
| D441,997 | S | 5/2001 | Lillelund | |
| 6,382,482 | B1 * | 5/2002 | Chao | 224/312 |
| 7,052,098 | B1 | 5/2006 | Greiner | |
| 7,318,568 | B2 * | 1/2008 | Barouta | 248/95 |
| D604,593 | S | 11/2009 | Seehoff | |
| 7,789,358 | B1 * | 9/2010 | Adams | 248/211 |
| 8,109,705 | B1 * | 2/2012 | Brown et al. | 411/344 |
| 8,353,086 | B2 | 1/2013 | Pike | |
| 2003/0183735 | A1 * | 10/2003 | Moerke et al. | 248/220.31 |
| 2006/0169858 | A1 * | 8/2006 | Krueger | 248/304 |
| 2011/0101183 | A1 * | 5/2011 | Ernst et al. | 248/216.1 |

* cited by examiner

*Primary Examiner* — Mark Wendell

(57) ABSTRACT

An improved jewelry holder having a body with a flat back surface that is adapted to releasably attach to a chosen surface, and a front surface including a primary curved surface and an attached flexible hook member having a secondary curved surface within close proximity to one another whereby the space therebetween creates a lead-in notch, a lead-out notch, and a chamber space whereby a piece of jewelry having a ring shape can be placed onto the flexible hook member by passing the flexible hook member through the inner area of the ring shape and pressing the piece of jewelry through the lead-in notch and lead out notch thereby safely retaining the piece of jewelry on a lower portion of the flexible hook member in the chamber space until the piece of jewelry is removed.

11 Claims, 5 Drawing Sheets

JEWELRY HOLDER

FIELD OF THE INVENTION

This invention relates to jewelry holders, particularly to holders for jewelry ring pieces.

BACKGROUND OF THE INVENTION

Small, valuable jewelry pieces, such as rings, are commonly stored for safekeeping on or in several varying types of jewelry holders. Known prior art jewelry holders range from ring dishes, wearable accessories, open hooks, stands with hooks and/or frustoconical pegs, and a wide array of jewelry boxes. These types of jewelry holders are typically stored on flat surfaces in various room spaces within ones home or workplace, or attached to an accessory worn by individuals. Many versions of prior art jewelry holders lend the jewelry pieces to be stored in a manner that leaves the jewelry susceptible to loss or damage resulting from interaction with pets, children, and other actions that can result in the jewelry pieces being accidentally knocked off of their storage container and therefore lost or damaged. Additionally, the majority of previously designed jewelry holders consist of clunky and stationary designs that create clutter to various room spaces and are not easily transitioned to different locations throughout ones home or workplace. Therefore, the need for an improved jewelry holder exists in order to both adequately and conveniently store and protect jewelry ring pieces from loss and damage in ones home or workplace.

Previous prior art jewelry holders that do not incorporate the novel features of the instant invention that are within the field include the following:

U.S. Pat. No. D441,997

This apparatus lends jewelry ring pieces susceptible to damage and loss as it does not protect jewelry ring pieces from being knocked off of the apparatus and into various hazards, such as a sink or trash can, while stored on the apparatus, and it also creates clutter on countertops and flat surfaces in various room spaces throughout ones home or workplace.

U.S. Pat. No. 2,665,042

This apparatus requires users to wear stored jewelry ring pieces on their bodies, therefore, the apparatus and any stored jewelry ring pieces on the apparatus can be misplaced and lost, additionally, it cannot be placed on common household surfaces for convenient storage around ones home or workplace.

U.S. Pat. No. 8,353,086

This apparatus requires users to wear stored jewelry ring pieces on an article of clothing on their bodies, therefore, the apparatus and any stored jewelry ring pieces on the apparatus can be misplaced and lost, it does not allow users to remove jewelry ring pieces from the holder with ease, and additionally it cannot be placed on common household surfaces for convenient storage around ones home or workplace.

U.S. Pat. No. D604,593

This apparatus does not securely hold jewelry ring pieces within an enclosed space, it does not protect jewelry rings from being knocked off while stored on the apparatus, and it does not have the capability to magnetize to surfaces.

U.S. Pat. No. 4,936,466

This apparatus is a clunky and stationary device that a user cannot transport with ease, it requires sufficient counter space for storage, it creates clutter to various room spaces, and it lends jewelry ring pieces susceptible to damage and loss as it does not protect jewelry rings from falling off while stored on the apparatus.

U.S. Pat. No. 7,052,098

This apparatus is a clunky and stationary device that a user cannot transport with ease, the elaborate design does not allow for quick, convenient placement or removal of jewelry ring pieces onto or from the apparatus, and it also requires sufficient counter space for storage.

SUMMARY OF THE INVENTION

This invention essentially consists of a body portion with a flat back surface that is adapted to releasably attach to a chosen surface, a front surface including a primary curved surface and an attached flexible hook member having a secondary curved surface within close proximity to one another whereby a space therebetween creates a lead-in notch on one side of the space and a lead-out notch on the other side of the space and a chamber space that is larger than the lead-out notch, such that a piece of jewelry having a ring shape can be placed onto the flexible hook member by passing the flexible hook member through the inner area of the ring shape and pressing the piece of jewelry through the lead-in and lead out notch, safely retaining the piece of jewelry on a lower portion of the flexible hook member in the chamber space until the piece of jewelry is removed.

One advantage over prior apparati is that this device safely retains jewelry ring pieces on the device, therefore reducing the risk that the pieces can be knocked off and lost or damaged.

Another advantage is the device is portable and has the capability to transition to various room spaces in ones home or workplace, without the need for counter surface space.

Another advantage is the ease with which jewelry ring pieces can be placed on to or removed from the device.

The novel features of the present invention are set forth in the claims herein. The functionality, modes of operation, purposes, and advantages of this invention can be further understood with reference to the following drawings and description of the preferred embodiment.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty, which characterize the invention, are pointed out with particularity in the claims annexed to and forming a part of this disclosure. For a better understanding of the invention, its operating advantages and the specific objects attained by its uses, reference should be made to the accompanying drawings and descriptive matter, which contains illustrated preferred embodiments of the invention.

DETAILED DESCRIPTION OF THE PREFERRED EMBODIMENT

Figure 1:
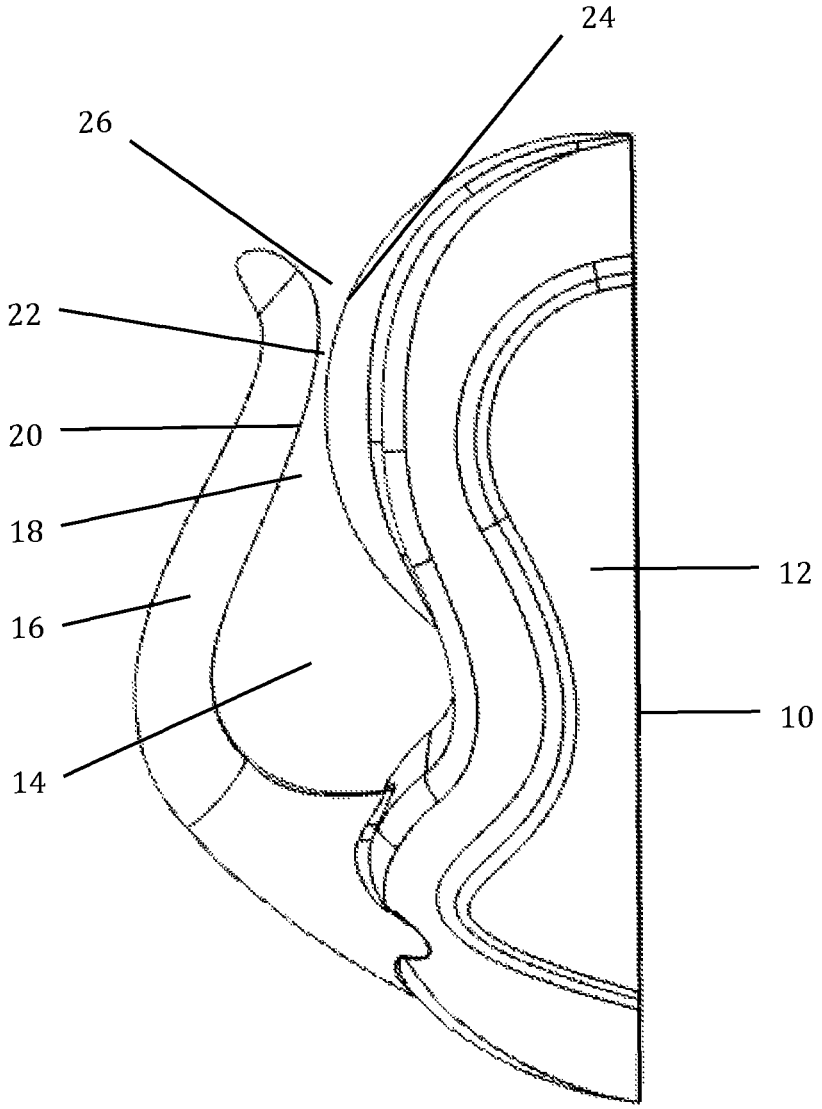
FIG. 1 is a left side view of the improved jewelry holder in accordance with one embodiment, the right side being a mirror image.
Figure 2:
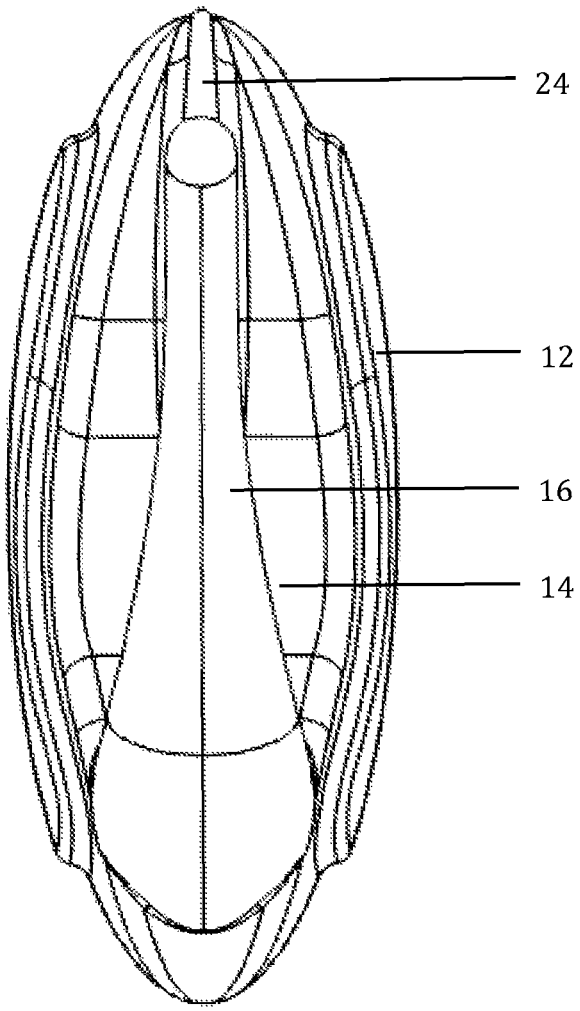
FIG. 2 is a front view of the improved jewelry holder.

As per FIG. 1, the improved jewelry holder comprises a body (12), formed from a material chosen from a group of materials comprising plastic, metal, rubber, and synthetics, with a front surface including a primary curved surface (24) and an attached flexible hook member (16) having a secondary curved surface (20) that is positioned in close proximity to said primary curved surface (24) leaving a space (22) therebetween forming a lead-in notch (26) on one side of said space (22) and a lead-out notch (18) on the other side of said space (22) and a chamber space (14) that is larger than said lead-out notch (18) whereby a piece of jewelry having a ring shape can be placed onto said flexible hook member (16) by passing said flexible hook member (16) through the inner area of the ring shape into said lead-in notch (26), then pressed into said space (22) formed between said primary curved surface (24) and secondary curved surface (20) as said flexible hook member (16) flexes and said space (22) becomes larger, then pressed out from said space (22) and through said lead-out notch (18) and into said chamber space (14) and onto a lower portion of said flexible hook member (16), thereby safely retaining the piece of jewelry thereon until the piece of jewelry is removed.

Figure 3:
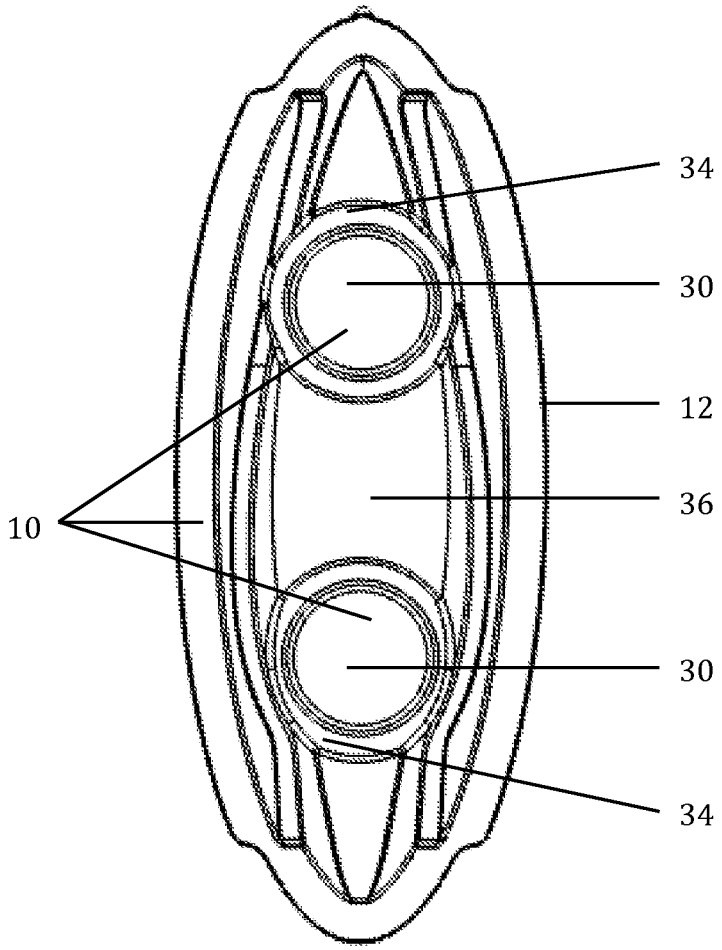
FIG. 3 is a rear view of the improved jewelry holder utilizing more than one connector member.

As per FIG. 3, the body (12) of the improved jewelry holder has a flat back surface consisting of a partially hollow interior (36) containing two connector retainers (34) each of which securely holds a connector member (30) and wherein said connector members (30), which are magnets, and/or the back surface of said body (12), have a rubber coating (10) thereon.

Figure 4:
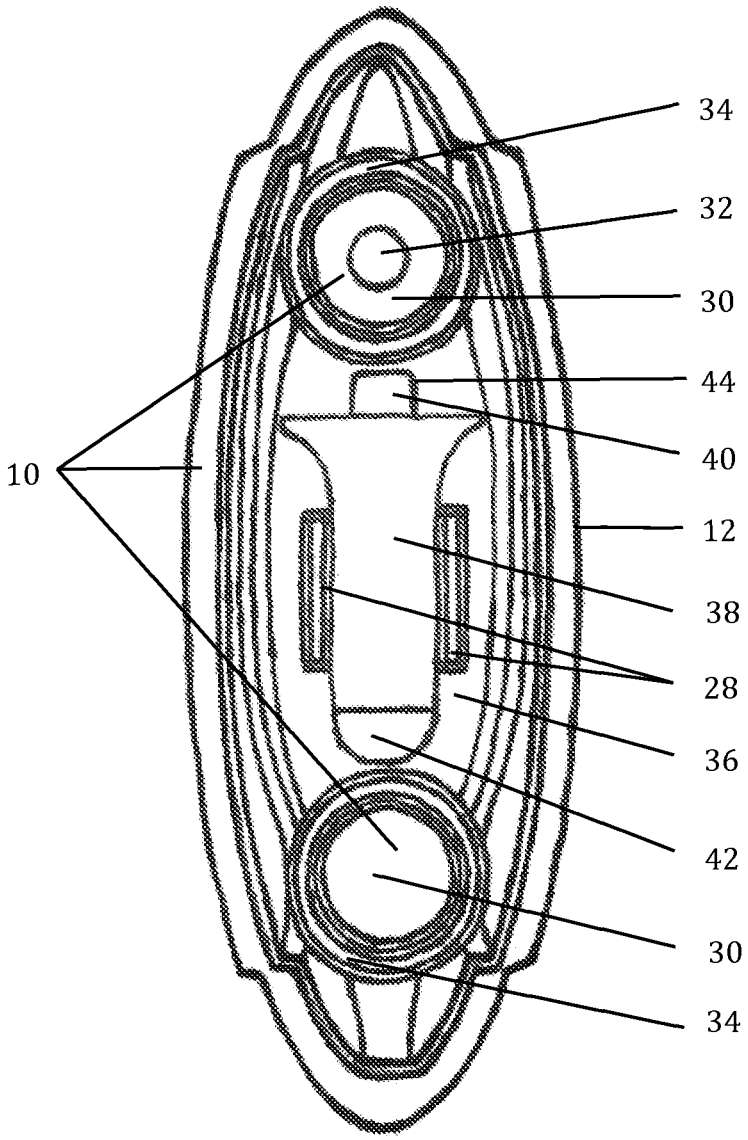
FIG. 4 is a rear view of a second embodiment of the improved jewelry holder utilizing more than one connector member and an outlet plug stored between outlet plug holder pins within a partially hollow interior space.

As per FIG. 4, an alternate embodiment of the improved jewelry holder whereby the flat back surface of the body (12) consists of two connector retainers (34) each of which securely holds a connector member (30), which is a magnet, and wherein said connector members (30) and/or the back surface of said body (12) have a rubber coating (10) thereon and whereby there exists a partially hollow interior (36) forming at least one opening through the back surface, and further includes a pair of flexible outlet plug holder pins (28) attached within said partially hollow interior (36) and adapted to releasably hold an outlet plug (38) therebetween and within said partially hollow interior (36); and wherein said outlet plug (38) is adapted to fit within a ground portion of an outlet that is within a wall surface, said outlet plug (38) including a ground plug portion (42) on one end and a magnetic connector portion (40) on an opposite end thereof, such that said outlet plug (38) can be stored with said partially hollow interior (36) of said body portion (12) by said outlet plug holder pins (28) and when needed, removed therefrom and attached to one of the magnet connector members (30) by attaching said magnetic connector portion (40), formed as having a male connector portion (44), to said magnet connector member (30), formed as having a female connector portion (32), such that when said magnetic connector portion (40) is magnetically connected to said magnet connector member (30) the male connector portion (44) and the female connector portion (32) connect and increase the strength of the connection therebetween and thereby adapt said jewelry holder to removably attach upon said wall via said outlet using the ground plug portion (42) of said outlet plug (38).

Figure 5:
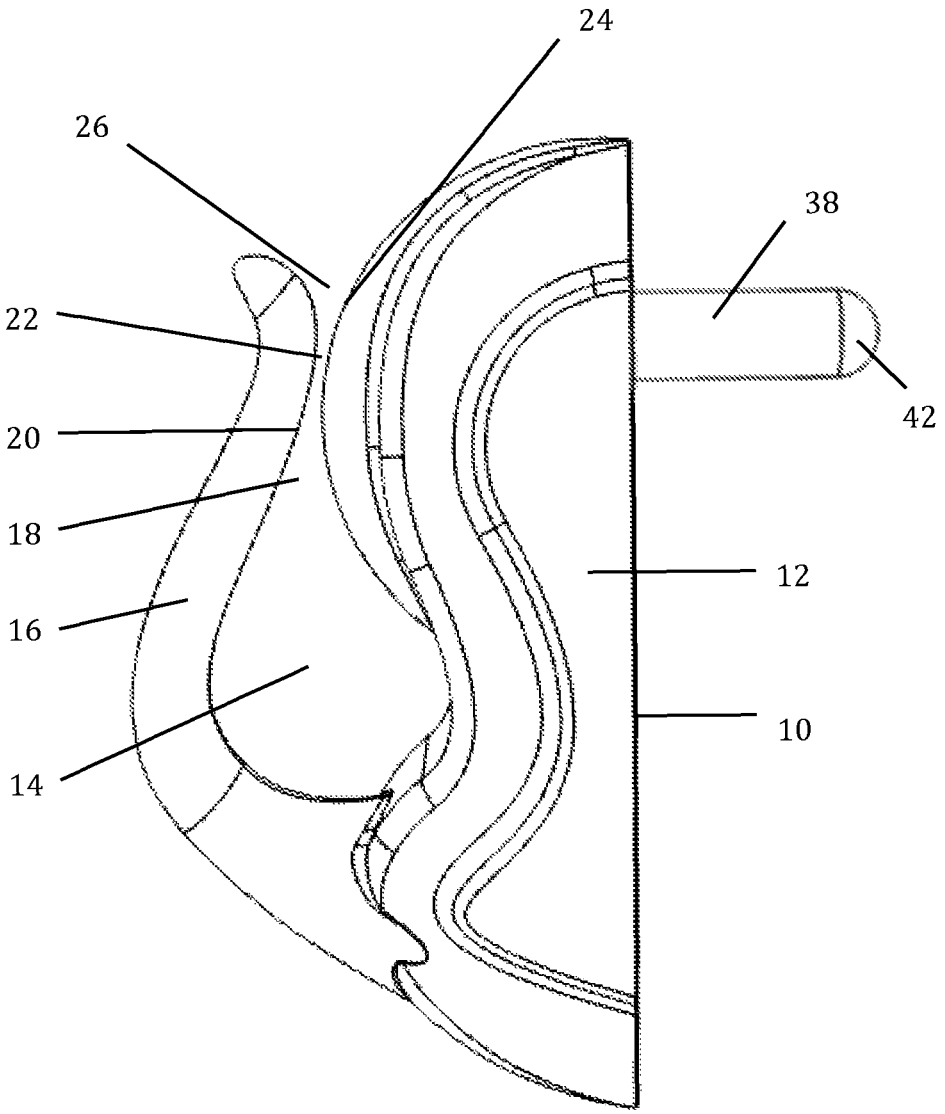
FIG. 5 is a left side view of the second embodiment whereby the outlet plug is attached to the magnet connector member and adapted to removably attach upon a wall via an outlet using the ground plug portion of the outlet plug, the right side being a mirror image.

As per FIG. 5, a side view of the alternate embodiment of the improved jewelry holder whereby the outlet plug (38) has been removed from the outlet plug holder pins (28) within the partially hollow interior (36) and whereby said magnetic connector portion (40) of said outlet plug (38), formed as having a male connector portion (44), and said magnet connector member (30), formed as having a female connector portion (32), have connected and increased the strength of the connection therebetween and thereby adapted said jewelry holder to removably attach upon said wall via said outlet using the ground plug portion (42) of said outlet plug (38).

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. An improved jewelry holder comprising a body portion having a flat back surface, at least one connector member removably attached to said back surface and adapted to releasably attach said jewelry holder to a chosen surface, and a front surface including a primary curved surface thereon; a flexible hook member attached to a portion of said front surface a distance from said primary curved surface, said flexible hook member having a secondary curved surface that is positioned in close proximity to said primary curved surface leaving a space therebetween forming a lead-in notch on one side of said space and a lead-out notch on the other side of said space and a chamber space that is larger than said lead-out notch, such that a piece of jewelry having a ring shape can be placed over said flexible hook member, such that said flexible hook member passes through an inner area of said ring shape, into said lead-in notch, then pressed into said space formed between said primary and secondary curved surfaces as said flexible hook member flexes and said space becomes larger, then pressed out from said space and through said lead-out notch and into said chamber space and onto a lower portion of said flexible hook member, thereby safely retaining said piece of jewelry thereon until said piece of jewelry is retrieved by reversing these steps.

2. The improved jewelry holder of claim 1, wherein said body portion further includes at least one connector retainer therein that extends through said back surface, and wherein each said at least one connector retainer is adapted to securely hold a connector member therein.

3. The improved jewelry holder of claim 2, wherein said at least one connector member is a magnet.

4. The improved jewelry holder of claim 3, wherein said body portion has a partially hollow interior forming at least one opening through said back surface, and further includes a pair of flexible outlet plug holder pins attached within said partially hollow interior and adapted to releasably hold an outlet plug therebetween and within said partially hollow interior; and wherein said connector member is an outlet plug adapted to fit within a ground portion of an outlet that is within a wall surface, said outlet plug including a ground plug portion on one end and a magnetic connector portion on an opposite end thereof, such that said outlet plug can be stored with said partially hollow interior of said body portion by said outlet plug holder pins and when needed removed therefrom and attached to said magnet connector member by attaching said magnetic connector portion thereto, and thereby adapting said jewelry holder to be removably attached upon said wall via said outlet.

5. The improved jewelry holder of claim 3, wherein there are two connector retainers and two magnets, one magnet secured within each respective connector retainer.

6. The improved jewelry holder of claim 5, wherein said magnets have a rubber coating upon their respective exposed surfaces.

7. The improved jewelry holder of claim 4, wherein said magnetic connector portion of said outlet plug is formed as having a male connector portion, and said magnet connector member is formed as having a female connector portion, such that when said magnetic connector portion is magnetically connected to said magnet connector member the male and female connector portions connect and increase the strength of the connection therebetween.

8. The improved jewelry holder of claim 4, wherein said body portion is formed from a metallic material, and said outlet plug is formed from a plastic material.

9. The improved jewelry holder of claim 1, wherein said jewelry holder is formed from a material chosen from a group of materials comprising plastic, metal, rubber, and synthetics.

10. The improved jewelry holder of claim 1, wherein said back surface includes a rubber coating thereon.

11. The improved jewelry holder of claim 1, wherein the edges of said jewelry holder are curved and smooth.

* * * * *